US011454045B2

(12) United States Patent
Miller

(10) Patent No.: US 11,454,045 B2
(45) Date of Patent: Sep. 27, 2022

(54) ROTATING DOOR HANDLE FOR EASE OF USE

(71) Applicant: Arconic Inc., Pittsburgh, PA (US)

(72) Inventor: Matthew M. Miller, Dunwoody, GA (US)

(73) Assignee: Arconic Corporation, Pittsburg, PA (US)

( * ) Notice: Subject to any disclaimer, the term of this patent is extended or adjusted under 35 U.S.C. 154(b) by 934 days.

(21) Appl. No.: 16/012,221

(22) Filed: Jun. 19, 2018

(65) Prior Publication Data

US 2019/0383055 A1 Dec. 19, 2019

(51) Int. Cl.

| | |
|---|---|
| ***E05B 81/00*** | (2014.01) |
| ***E05B 1/00*** | (2006.01) |
| ***E05B 5/02*** | (2006.01) |

(52) U.S. Cl.

CPC ..... *E05B 1/003* (2013.01); *E05B 5/003* (2013.01)

(58) Field of Classification Search

CPC ..... E05B 1/003; E05B 1/04; E05B 1/0053; E05B 1/0061; E05B 5/003; E05B 3/00; Y10T 292/57; Y10T 16/458; Y10T 16/473; Y10S 292/53; Y10S 292/60

See application file for complete search history.

(56) References Cited

U.S. PATENT DOCUMENTS 2,486,586 A * 11/1949 Brittain ..... E05B 5/003 292/1
7,270,352 B1 * 9/2007 Stuart ..... E05B 1/0053 292/255
9,999,970 B2 * 6/2018 Browning ..... B25G 1/102

FOREIGN PATENT DOCUMENTS

DE 10217770 A1 * 1/2003 ..... E05B 1/003
EP 1749952 A2 * 2/2007 ..... E05B 65/1066

OTHER PUBLICATIONS

Machine translation of DE 10217770A1 (Year: 2003).*

* cited by examiner

*Primary Examiner* — Christine M Mills
*Assistant Examiner* — Christopher F Callahan
(74) *Attorney, Agent, or Firm* — von Briesen & Roper, s.c.

(57) ABSTRACT

A handle operably coupled to rotating door handle assembly is disclosed. The handle may include a first rotatable member configured to engage a door latch mechanism. The handle may further include a second member mechanically engaged with the first member and the second member may be extended a length between a non-extended position and an extended position. A handle cavity may be defined within at least a portion of the second member and a bar may be enclosed within the handle cavity. Furthermore, an extension mechanism may be incorporated with the bar and the second member and configured to extend the bar from the cavity when the second member is in the extended position and retract the bar within the cavity when the second member is in the non-extended position.

21 Claims, 7 Drawing Sheets

ROTATING DOOR HANDLE FOR EASE OF USE

TECHNICAL FIELD

The present disclosure generally relates to rotating door handles.

BACKGROUND

Senior citizens comprise one of the largest growing populations in numerous countries around the world. As people age, certain physical limitations may arise that impact an individual's daily routine and ability to perform certain tasks such as but not limited to, opening and closing a door, walking up and down stairs, walking across carpeting and other such tasks. The effects created by physical limitations may impact where senior citizens are able to live and in some cases, may cause individuals to move out of their long-time home. However, the ability to remain in one's home is often viewed as the desired choice because it may provide several social, health and financial benefits.

Although certain door handles and door handle accessories are effective for reducing the physical strength needed to open the door, these solutions may first require identification of the door where the alternative handle is needed. Once identified, the difficult-to-operate door handle may need to be removed and replaced with the alternative door handle. For example, a longer door handle may be installed in place of a handle installed on a door that a person with certain physical limitations may have difficulty opening. Additionally, a door handle adapter may be installed over the door handle that makes it easier to open the door. However, as noted above, these solutions may need to be implemented on each door where they are needed and usually only after an issue with door operation is encountered. Furthermore, the alternative door handles and accessories may pose difficulties to individuals not familiar with how to properly use them to open and/or close a door.

Thus, there is a need for a cost-effective and versatile handle that can accommodate a variety of users, some of which may benefit from an adjustable handle to make it easier to open a door.

SUMMARY

An embodiment of a handle is disclosed. The handle may include a first rotatable member configured to engage a door latch mechanism. Furthermore, the handle may include a second member mechanically engaged with the first member, wherein a length of the second member is adjustable.

In an embodiment of the handle, the handle may further comprise a bar extendably coupled between a non-extendable portion and an extendable portion of the second member.

In yet another embodiment of the handle, a cavity may be defined within a portion of at least one of the non-extendable portion and the extendable portion, and wherein the bar may be enclosed within the cavity when the second member is in a non-extended position and the bar is extended from the cavity between the non-extendable portion and the extendable portion when the second member is in an extended position.

In another embodiment of the handle, the handle may further comprise a sheath portion configured to cover a portion of the bar between the non-extendable portion and the extendable portion when the second member is in the extended position.

In another embodiment of the handle, the handle may further comprise an extension mechanism operably engaged with the non-extendable portion, the extendable portion, and the bar, wherein the extension mechanism may be configured to extend the bar between the non-extendable portion and the extendable portion when the second member is in the extended position and retract the bar within the cavity when the second member is in the non-extended position.

In another further embodiment of the handle, the extension mechanism may include a spring pin and a button operably coupled to the spring pin. Moreover, activation of the button and the spring pin may allow the bar to adjust the second member between the extended position and the non-extended position.

In another further embodiment of the handle, the extension mechanism may further include a track system defined along the bar and activation of the button may engage the spring pin with the track system to allow the bar to adjust the second member between the extended position and the non-extended position.

In another further embodiment of the handle, the button may be operably coupled to a lever mechanism and the spring pin may engage with a plurality of notches defined along the bar. Moreover, activation of the button may cause the lever mechanism to disengage the spring pin from the plurality of notches to allow the bar to adjust the second member between the extended position and the non-extended position.

In another further embodiment of the handle, the button may be further coupled to a first magnet and the spring pin may be coupled to a second magnet. Activation of the button may cause the lever mechanism to adjacently position the first magnet and the second magnet such that the first and second magnets are attracted towards each other to disengage the spring pin from the plurality of notches to allow the bar to adjust the second member between the extended position and the non-extended position.

In another further embodiment of the handle, the extension mechanism may include a spur gear and a plurality of gear teeth defined along the bar and the spur gear may engage with the plurality of gear teeth to adjust the second member between the extended position and the non-extended position.

In another further embodiment of the handle, the extension mechanism may include a compression mechanism operably coupled to the bar and the compression mechanism may include a tab portion. Activation of the tab portion may allow the bar to adjust the second member between the extended position and the non-extended position.

An embodiment of a door handle assembly operably coupled to a door is disclosed. The door handle assembly may include a latch mechanism operably coupled to the door and a mounting plate attached to a surface of the door. The door handle assembly may further include a first rotatable member coupled to the mounting plate and configured to engage the latch mechanism and a second member may be mechanically engaged with the first member, wherein a length of the second member is adjustable.

In a further embodiment of the door handle assembly, the door handle assembly comprises a bar extendably coupled between a non-extendable portion and an extendable portion of the second member.

In a further embodiment of the door handle assembly, a cavity may be defined within a portion of at least one of the non-extendable portion and the extendable portion. The bar may be enclosed within the cavity when the second member is in a non-extended position and the bar is extended from the cavity between the non-extendable portion and the extendable portion when the second member is in an extended position.

In a further embodiment of the door handle assembly, the door handle assembly may further comprise an extension mechanism operably engaged with the non-extendable portion, the extendable portion, and the bar. The extension mechanism may be configured to extend the bar between the non-extendable portion and the extendable portion when the second member is in the extended position and retract the bar within the cavity when the second member is in the non-extended position.

In a further embodiment of the door handle assembly, the extension mechanism may include a spring pin and a button operably coupled to the spring pin. Activation of the button and the spring pin may allow the bar to adjust the second member between the extended position and the non-extended position.

In a further embodiment of the door handle assembly, the extension mechanism may include a spur gear and a plurality of gear teeth defined along the bar and the spur gear may engage with the plurality of gear teeth to adjust the second member between the extended position and the non-extended position.

In a further embodiment of the door handle assembly, the extension mechanism may include a compression mechanism operably coupled to the bar and the compression mechanism may include a tab portion. Activation of the tab portion may allow the bar to adjust the second member between the extended position and the non-extended position.

An embodiment of a door handle assembly operably coupled to a door is disclosed. The door handle assembly may include a latch mechanism operably coupled to the door and a mounting plate attached to a surface of the door. Furthermore, a first rotatable member may be coupled to the mounting plate and configured to engage the latch mechanism and an extendable handle portion including a non-extendable portion and an extendable portion may be mechanically engaged with the first member. The door handle assembly may further include a bar extendably coupled between the non-extendable portion and the extendable portion and the bar may extend a length between the non-extendable portion and the extendable portion to adjust the extendable handle between a non-extended position and an extended position.

In an embodiment of the door handle assembly, the door handle assembly may further comprise an extension mechanism operably engaged with the non-extendable portion, the extendable portion and the bar. The extension mechanism may be configured to extend the bar between the non-extendable portion and the extendable portion when the extendable handle is in the extended position. Furthermore, the extension mechanism may be configured to retract the bar within a cavity defined within a portion of at least one of the non-extendable portion and the extendable portion when the extendable handle is in the non-extended position.

These and other aspects and features of the present disclosure will be more readily understood when read in conjunction with the accompanying drawings.

DETAILED DESCRIPTION

Figure 2:
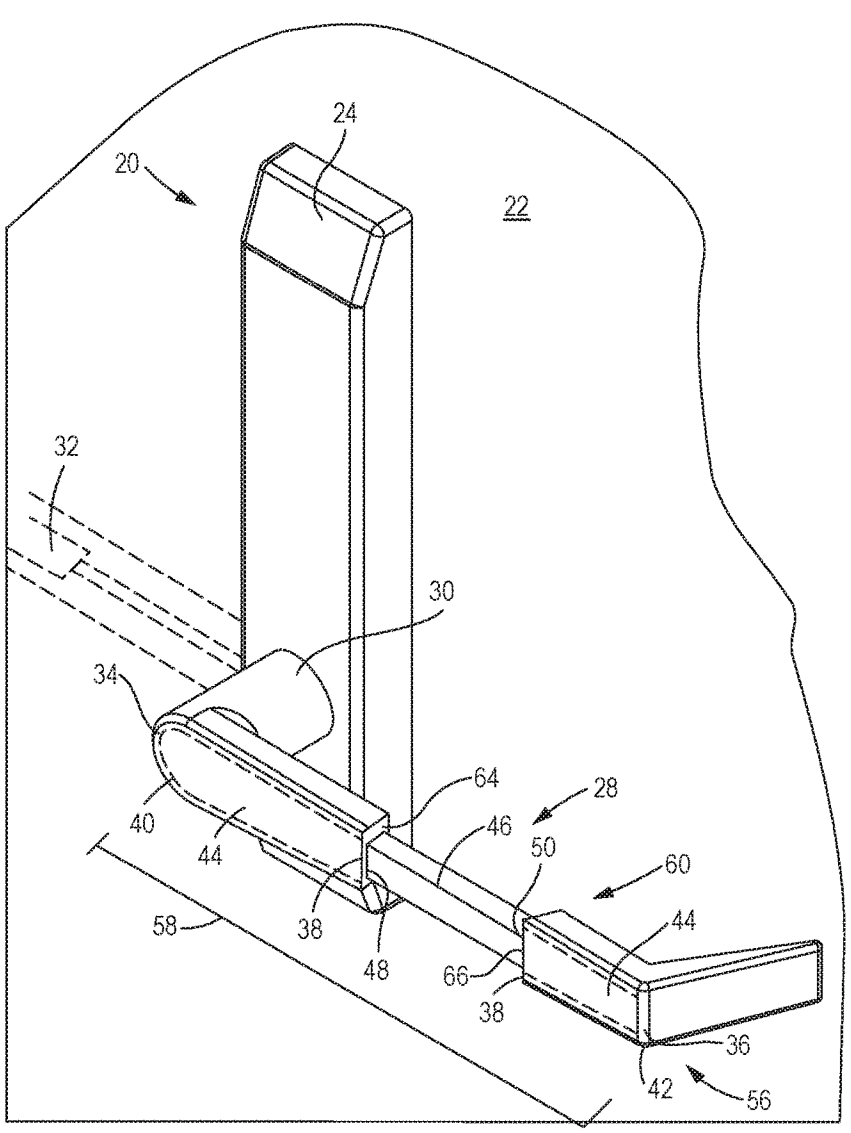
FIG. 2 is a perspective view of the rotating door handle assembly of FIG. 1 in an extended position, constructed in accordance with the present disclosure.
Figure 1:
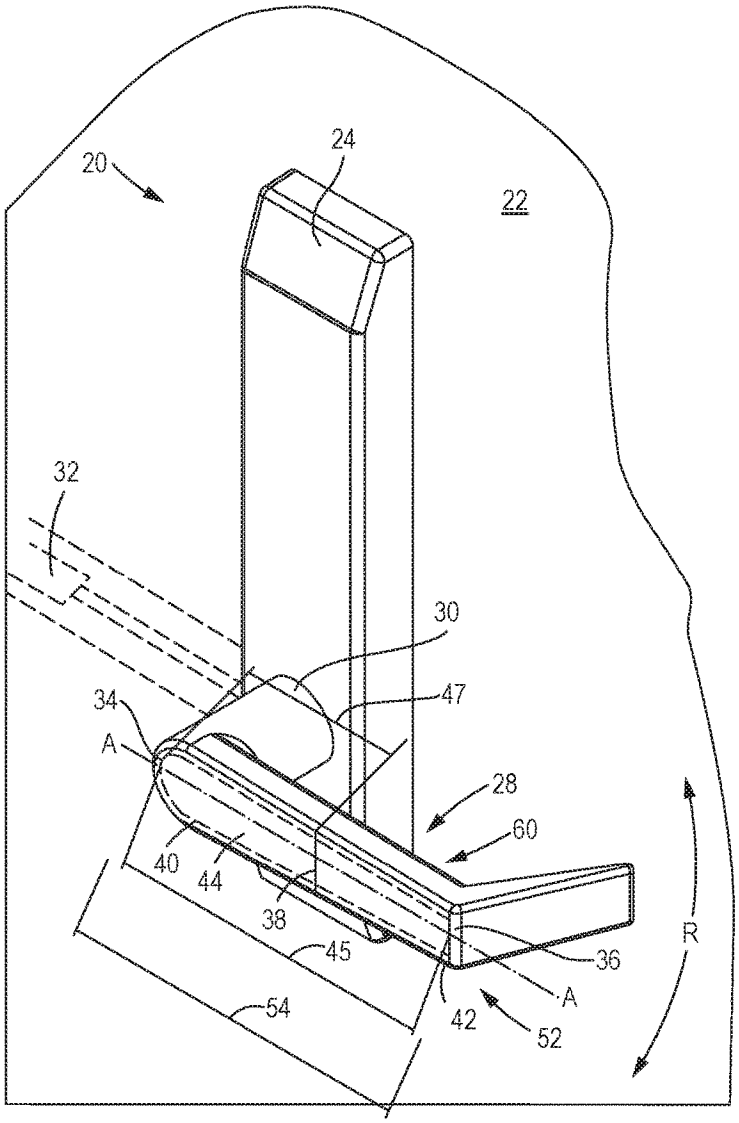
FIG. 1 is a perspective view of a rotating door handle assembly coupled to a door, constructed in accordance with the present disclosure.

Referring now to the drawings, and with specific reference to FIGS. 1 and 2, a rotating door handle assembly 20 attached to a door 22 is shown. The rotating door handle assembly 20 may include a mounting plate 24 that operably and fixedly attaches the rotating door handle assembly 20 to the door 22. The mounting plate 24 may further include a lock mechanism (not shown) which provides access to a key or other such paired security device for locking and unlocking the door 22. Alternatively, and/or additionally, a keypad (not shown) may be incorporated into the mounting plate 24 and used to enter a code to activate and/or deactivate the lock mechanism. The rotating door handle assembly 20 may further include an adjustable handle portion 28 operably coupled to a rotating cylinder 30. Applying an external force to the adjustable handle portion 28 may cause a subsequent rotation or other such movement of the rotating cylinder 30 and the adjustable handle portion 28 relative to the mounting plate 24, as illustrated by arrow R.

Furthermore, the rotating cylinder 30 may be operably coupled to a latch mechanism 32. The latch mechanism 32 may include an internal portion disposed within an interior portion of the door 22 and an external portion that engages with a latch catch (not shown) of the door 22. As such, movement of the adjustable handle portion 28 above or below a longitudinal axis A-A of the adjustable handle portion 28 causes rotation of the rotating cylinder 30 in the direction of arrow R (e.g., clockwise or counterclockwise). The rotation of the rotating cylinder 30 may activate with the latch mechanism 32 to retract and disengage the external portion of the latch mechanism 32 from the latch catch (not shown) so the door may be pulled or pushed open. Conversely, movement to return the adjustable handle portion 28 to a central position along the longitudinal axis A-A may rotate the rotating cylinder 30 to extend the latch mechanism 32 and engage the external portion of the latch mechanism with the latch catch (not shown) to close and secure the door 22. It will be understood that the rotating door handle assembly 20 including the adjustable handle portion 28 may be used to open and close a variety of doors such as but not limited to, exterior dwelling unit doors, interior dwelling unit doors, safe or vault doors, aircraft pressurized cabin doors, marine vessel hatch doors and the like.

In an embodiment, the adjustable handle portion 28 has a first end 34 coupled to the rotating cylinder 30 and second end 36 that extends axially away from the first end 34 along the longitudinal axis A-A of the adjustable handle portion 28. Furthermore, a handle seam 38 may be defined between the first end 34 and the second end 36 and the handle seam 38 may divide the adjustable handle portion 28 into separate portions. In one non-limiting example, a non-extendable handle portion 40 and an extendable handle portion 42 are defined by the handle seam 38 in the adjustable handle portion 28. The non-extendable handle portion 40 is coupled to the rotating cylinder 30 and extends from the first end 34 to the handle seam 38. Likewise, the extendable handle portion 42 extends from the handle seam 38 to the second end 36 of the adjustable handle portion 28. Furthermore, it will be understood that the handle seam 38 may be positioned along the adjustable handle portion 28 to determine a desired size of the non-extendable handle portion 40, the extendable handle portion 42 or other part of the adjustable handle portion 28. For example, the handle seam 38 may be defined at a location of the adjustable handle portion 28 such that one of the non-extendable handle portion 40 and the extendable handle portion 42 is larger than the other. Alternatively, the handle seam 38 may be defined at a location of the adjustable handle portion 28 such that the non-extendable handle portion 40 and the extendable handle portion 42 are substantially the same size (i.e., within defined design tolerances).

The adjustable handle portion 28 may further include a handle cavity 44 that is formed or otherwise defined within an interior area of the adjustable handle portion 28. In an embodiment, the handle cavity 44 may have a first length 45 that extends from the first end 34 to the second end 36 of the adjustable handle portion 28. In another example, the handle cavity 44 may have a second length 47 that extends within a portion of the non-extendable handle portion 40 and a portion the extendable handle portion 42. In yet another example, the handle cavity 44 may be defined in only one of the non-extendable handle portion 40 or the extendable handle portion 42 of the adjustable handle portion 28. Accordingly, it will be understood that the handle cavity 44 may be sized and configured within the non-extendable handle portion 40 and the extendable handle portion 42, as needed.

In an embodiment, the handle cavity 44 is configured to enclose a bar 46 within the handle cavity 44 and the bar 46 may extend from the non-extendable handle portion 40, across the handle seam 38, and into the extendable handle portion 42. As such, a first end 48 and a second end 50 of the bar 46 may each be slidably engaged with an interior surface of the handle cavity 44 such that applying a force to the extendable handle portion 42 along the longitudinal axis A-A (e.g., pull or push) may extend and/or retract the adjustable handle portion 28. For example, FIG. 1 illustrates the adjustable handle portion 28 in a retracted position 52 where the non-extendable handle portion 40 and the extendable handle portion 42 are adjacently positioned with respect to each other. Accordingly, the retracted position 52 defines a first handle length 54 of the adjustable handle portion 28, such as but not limited to 5.5 inches. When the adjustable handle portion 28 is in the retracted position 52 the non-extendable handle portion 40 and the extendable handle portion 42 may be in direct contact with each other at the handle seam 38. Furthermore, in the retracted position 52 the bar 46 may be fully enclosed or otherwise concealed within the handle cavity 44. Conversely, FIG. 2 illustrates the adjustable handle portion 28 in an extended position 56 where the non-extendable handle portion 40 and extendable handle portion 42 of the adjustable handle portion 28 are separated from one another with the bar 46 extended therebetween. As such, the extended position 56 may define a second handle length 58 of the adjustable handle portion 28, such as but not limited to 9.5 inches.

The adjustable handle portion 28 may further include an extension mechanism 60 configured to facilitate adjustment of the adjustable handle portion 28 between the retracted position 52 and the extended position 56. In an embodiment, the extension mechanism 60 may be configured such that at least one of the first end 48 and the second end 50 of the bar 46 is movably and/or slidably engaged with the internal surface of the handle cavity 44. Accordingly, activation of the extension mechanism 60 using an external force to pull on the adjustable handle portion 28 along the longitudinal axis A-A may cause the non-extendable handle portion 40 and the extendable handle portion 42 to separate at the handle seam 38. The bar 46 may slide along the internal surface of the handle cavity 44 and axially extend along the longitudinal axis A-A to adjust the adjustable handle portion 28 into the extended position 56. Conversely, activation of the extension mechanism 60 using an external force to push on the adjustable handle portion 28 may cause the non-extendable handle portion 40 and the extendable handle portion 42 to converge towards each other. The bar 46 may slide along the internal surface of the handle cavity 44 and axially retract along the longitudinal axis A-A to adjust the adjustable handle portion 28 into the retracted position 52.

Figure 3:
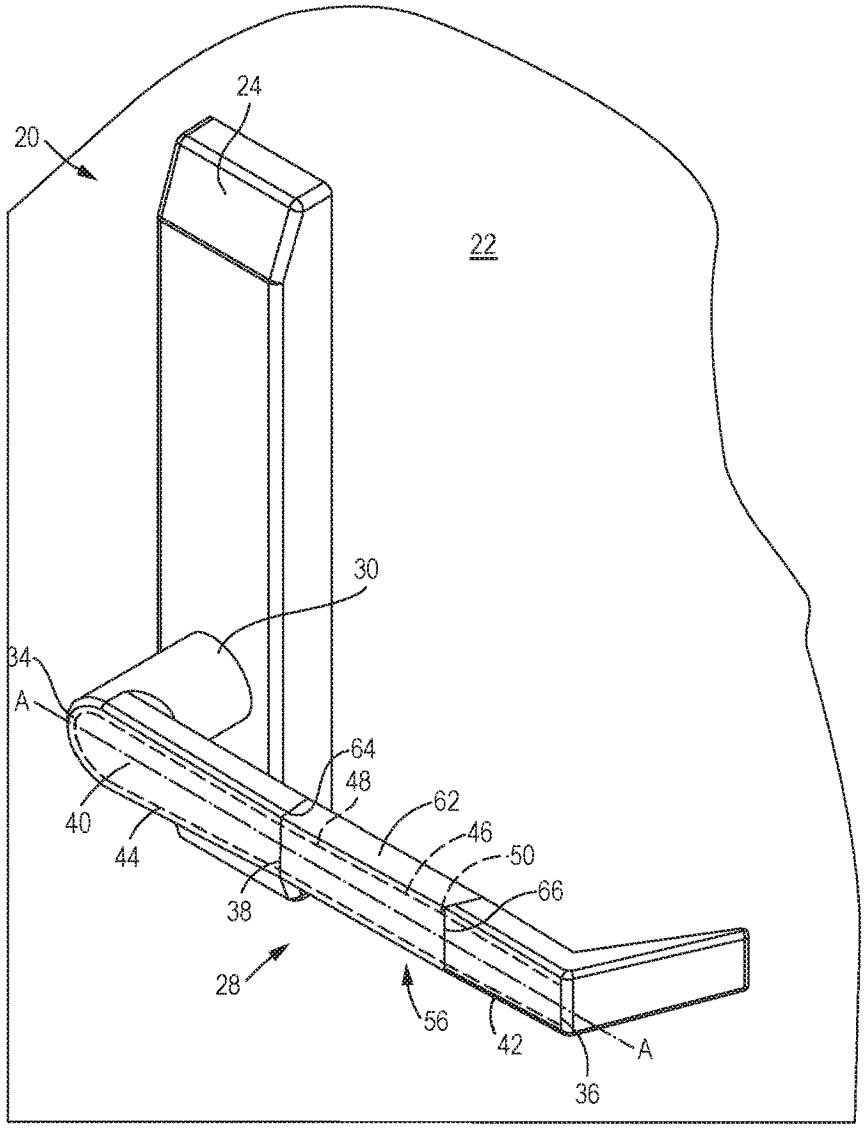
FIG. 3 is a perspective view of the rotating door handle assembly of FIG. 2 shown with a sheath, constructed in accordance with the present disclosure.

Turning now to FIG. 3, an embodiment of the adjustable handle portion 28 in the extended position 56 including a sheath 62 covering a portion of the bar 46 is illustrated. The sheath 62 may be disposed between the first end 48 and the second end 50 of the bar 46 to cover the exposed portion of the bar 46 between the non-extendable handle portion 40 and the extendable handle portion 42 when the adjustable handle portion 28 is in the extended position 56. Furthermore, in an embodiment, the sheath 62 and the adjustable handle portion 28 are made out of the same metal or metal alloy material such as but not limited to, aluminum, stainless steel, brass, polished nickel, chrome, and the like. The sheath 62 may further include a shape or other such contour that is complimentary to the non-extendable handle portion 40 and the extendable handle portion 42. For example, when the adjustable handle portion 28 is in the extended position 56 one end of the sheath 62 may be adjacently positioned to a first exposed seam face 64 (FIG. 2) on the non-extendable handle portion 40 and the opposing end of the sheath 62 may be adjacently positioned to a second exposed seam face 66 (FIG. 2) on the extendable handle portion 42. As a result, the complimentary shape of the sheath 62 may fit or otherwise pair with the first exposed seam face 64 and the second exposed seam face 66 to give the appearance that the non-extendable handle portion 40, the sheath 62 and the extendable handle portion 42 form a continuous or unitary structure.

Figure 4:
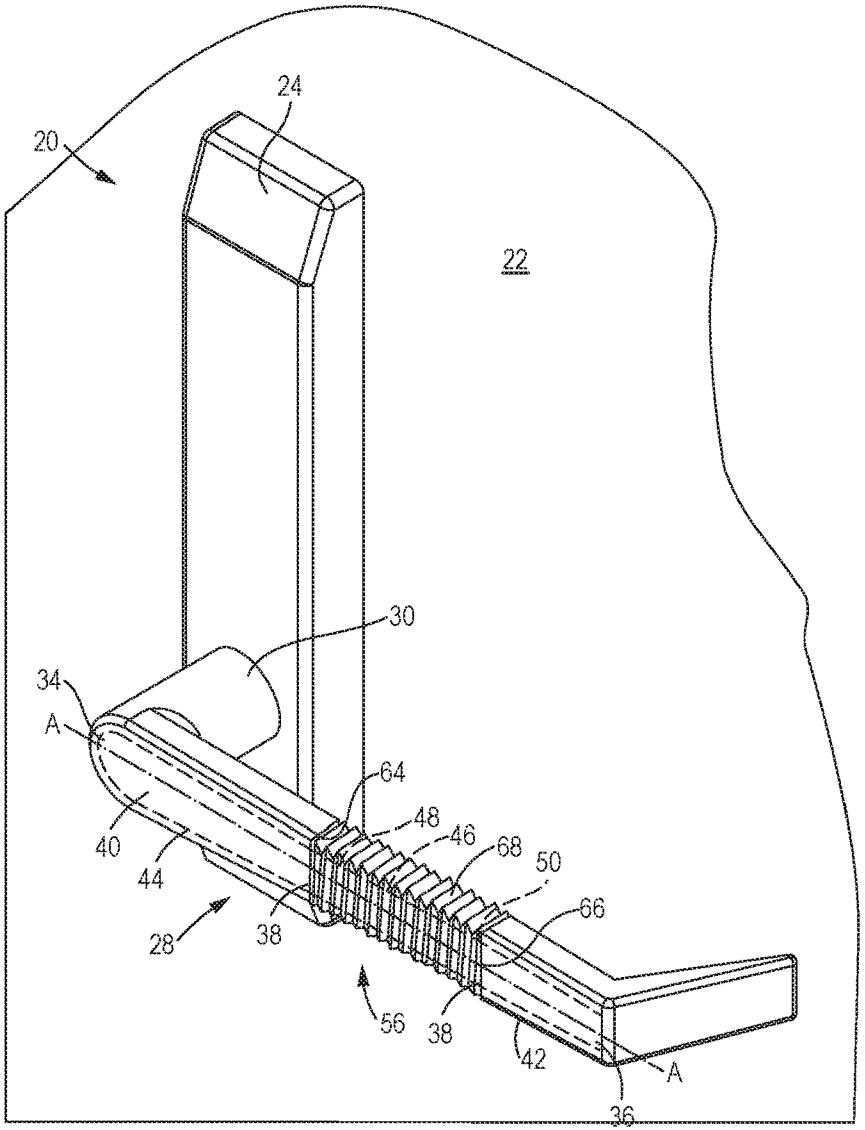
FIG. 4 is a perspective view of the rotating door handle assembly of FIG. 2 shown with a corrugated sheath, constructed in accordance with the present disclosure.

Furthermore, FIG. 4 shows an alternative embodiment of the adjustable handle portion 28 including a corrugated sheath 68 that covers the exposed portion of the bar 46 (FIG. 2) between the non-extendable handle portion 40 and the extendable handle portion 42 when the adjustable handle portion 28 is in the extended position 56. Similar to the sheath 62 shown in FIG. 3, the corrugated sheath 68 may be disposed between the first exposed seam face 64 and the second exposed seam face 66 to cover the exposed portion of the bar 46 between the non-extendable handle portion 40 and the extendable handle portion 42 when the adjustable handle portion 28 is in the extended position 56. In an embodiment, the corrugated sheath 68 is formed from rubber, silicone, Viton®, nitrile, neoprene or similar material. The corrugated sheath 68 may be sealingly engaged with the first and second exposed seam faces 64, 66 on each of the non-extendable handle portion 40 and the extendable handle portion 42, respectively. As a result, the corrugated sheath 68 may form a fluid tight seal between the non-extendable handle portion 40 and the extendable handle portion 42 that protects the bar 46 and handle cavity 44 (FIGS. 1-4) from dust, particles, fluid and other such contaminants present in the external environment.

Figure 5A:
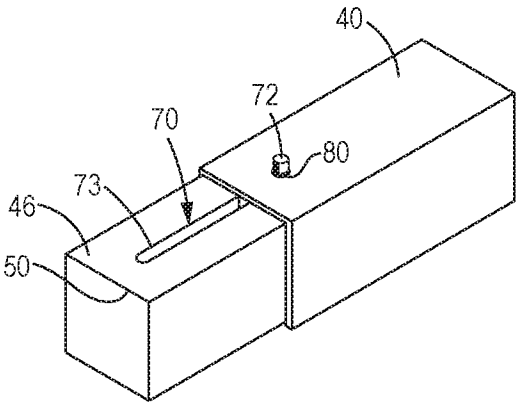
FIG. 5A is an elevated perspective view of an extension mechanism incorporated into the rotating door handle assembly of FIGS. 1-4, constructed in accordance with the present disclosure.
Figure 5B:
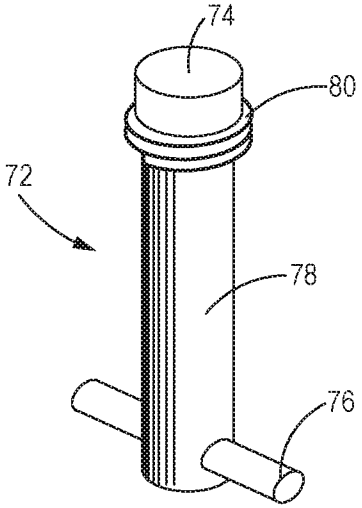
FIG. 5B is a perspective view of a spring pin of the extension mechanism of FIG. 5A, constructed in accordance with the present disclosure.
Figure 5C:
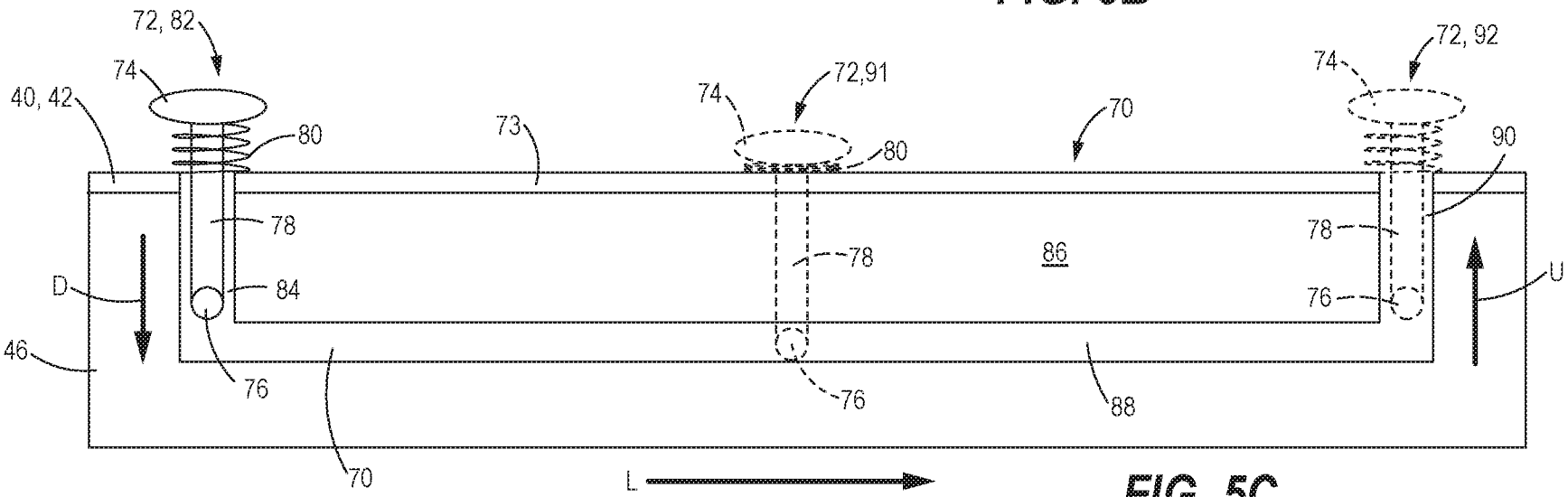
FIG. 5C is a side schematic view of the extension mechanism of FIG. 5A, constructed in accordance with the present disclosure.

Referring now to FIGS. 5A-5C, with continued reference to FIGS. 1-2, an embodiment of the extension mechanism 60 incorporated into the adjustable handle portion 28 is shown. The extension mechanism 60 may be configured to adjust the adjustable handle portion 28 between the retracted position 52 and the extended position 56. As such, the bar 46 may be slidably engaged with the interior surface of the handle cavity 44 defined in at least one of the non-extendable handle portion 40 and the extendable handle portion 42. Furthermore, an embodiment of the extension mechanism 60 may further include a track system 70 defined to extend along a specified length of the bar 46 and a spring pin 72. In one non-limiting example, the spring pin 72 extends through the outer surface of the non-extendable handle portion 40. The spring pin 72 is aligned with an upper longitudinal channel 73 of the track system 70 that is formed in the bar 46. For purposes of simplicity, FIG. 5A illustrates the spring pin 72 extending through the non-extendable handle portion 40 and the bar 46 but it will be understood that extension mechanism 60 may be additionally or alternately configured such that the spring pin 72 extends through the outer surface of the extendable handle portion 42.

One non-limiting example of the spring pin 72 is further illustrated in FIG. 5B. The spring pin 72 may include a button 74 defined at one end, a cross-member 76 defined at the opposite end and a pin shaft 78 extending therebetween. The cross-member 76 and the pin shaft 78 may generally be perpendicular or orthogonal with respect to one another defining a t-shape. Additionally, the pin shaft 78 may be configured to include a length and diameter that is compatible with dimensions the track system 70. The spring pin 72 further includes a spring 80 or other such elastic element which circumferentially surrounds the pin shaft 78. The top portion of the spring 80 is positioned adjacent to a bottom surface the button 74. The spring pin 72 may be inserted into the extension mechanism 60 such that the spring 80 and button 74 are positioned adjacent to the external surface of the non-extendable handle portion 40 and the cross-member 76 and the pin shaft 78 are aligned with and extend downwards into the track system 70.

Moreover, the bottom portion of the spring 80 may be in direct contact with the external surface of the non-extendable handle portion 40. Accordingly, the spring 80 biases the spring pin 72 such that the cross-member 76 and pin shaft 78 may be suspended within the track system 70. Applying a downward force to the button 74 (i.e., pressing or holding button down) may compress the spring 80 between the button 74 and the external surface of the non-extendable handle portion 40. Subsequently, the compression of the spring 80 along with the downward force may urge the spring pin 72 in the downward direction, as illustrated by arrow D. Conversely, removal of the downward force from the button 74 (i.e., releasing button) may allow the spring 80 to expand back to its original, uncompressed state and the restoring spring force may bias the spring pin 72 in an upward direction, as illustrated by arrow U.

As further illustrated in FIG. 5C, when the adjustable handle portion 28 is in the retracted position 52 (FIG. 1) the spring pin 72 may be in a first locked position 82. Accordingly, in the first locked position 82 the cross-member 76 and a portion of the pin shaft 78 may be suspended within a first vertical channel 84 of the track system 70. Furthermore, in the suspended position, the cross-member 76 and the pin shaft 78 are aligned with and obstructed by a locking portion 86 of the track system 70. Accordingly, interaction between the spring pin 72 and the locking portion 86 of the track system 70 may restrict or otherwise block the bar 46 from sliding in a longitudinal direction represented by the arrow L.

During extension of the adjustable handle portion 28, applying the downward force on the button 74 may urge the spring pin 72 downward in the first vertical channel 84 such that at least a portion of the spring pin 72 is positioned in a lower longitudinal channel 88. As further illustrated in FIG. 5C an intermediate position 91 of the spring pin 72 shown in dashed lines illustrates the cross-member 76 aligned with the lower longitudinal channel 88. The lower longitudinal channel 88 provides an unobstructed longitudinal pathway for the cross-member 76 and lower portion of the pin shaft 78 within the track system 70. Furthermore, the upper portion of the pin shaft 78 remains aligned with the upper longitudinal channel 73 of the track system 70 and the bar 46 becomes free to slide or extend from the non-extendable handle portion 40.

FIG. 5C further illustrates a second vertical channel 90 associated with a second locked position 92 of the track system 70. Furthermore, a spring pin 72 is shown in dashed lines as to illustrate the position of the spring pin 72 at the second locked position 92. Once the bar 46 is fully extended the downward force may be removed from the button 74 and the spring 80 expands back to its original uncompressed state. Accordingly, the restoring spring force may cause the cross-member 76 and lower portion of the pin shaft 78 to retract in an upward direction through the second vertical channel 90, as illustrated by arrow U. The second vertical channel 90 defines the second locked position 92 associated with the extended position 56 of the adjustable handle portion 28 (FIG. 2). Similar, to the first locked position 82, when the spring pin 72 is moved into the second locked position 92, the cross-member 76 may be suspended within a second vertical channel 90 of the track system 70 and aligned with a locking portion 86 of the track system 70. As a result, the bar 46 may be locked or otherwise restricted from moving from the extended position 56. To retract the bar 46, and return the handle member to the retracted position 52 (FIG. 1), the downward force may be reapplied to the button 74 to urge the cross-member 76 downward into the lower longitudinal channel 88. The bar 46 may then slide or otherwise move in the longitudinal direction opposite of arrow L until the spring pin 72 is returned back to the first locked position 82. While FIG. 5C illustrates two positions of the spring pin 72 (e.g., first locked position 82 and second locked position 92) it will be understood that the track system 70 may include one or more intermediate locking positions to provide additional adjustment points during the extension and/or retraction of the adjustable handle portion 28.

Figure 6:
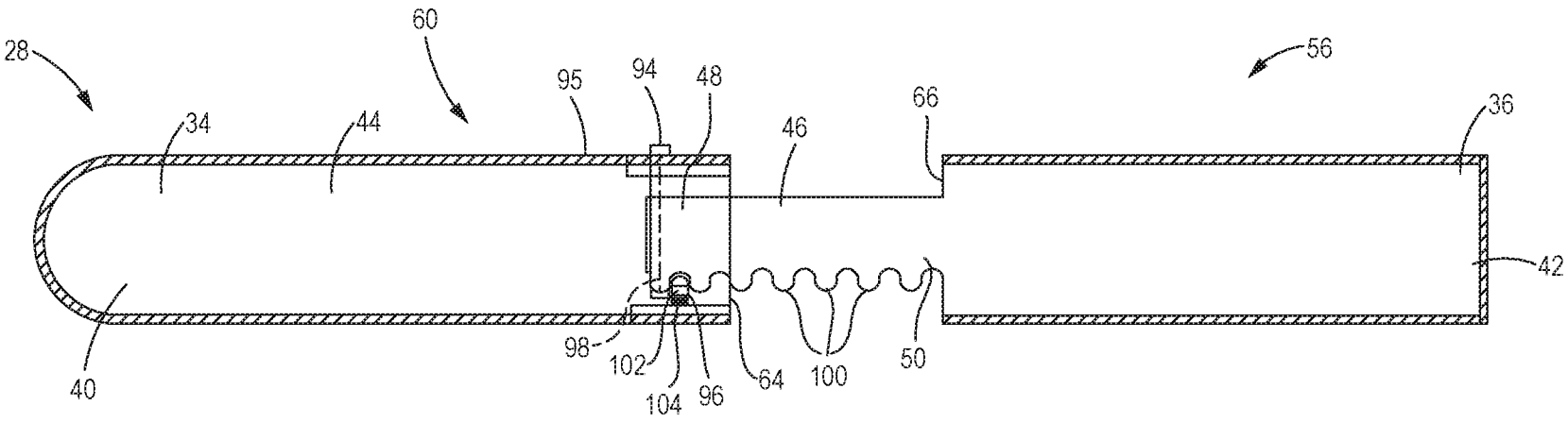
FIG. 6 is a front, cross-sectional view of the extension mechanism of the rotating door handle assembly of FIGS. 1-4 including a button, lever and spring pin, constructed in accordance with the present disclosure
Figure 7:
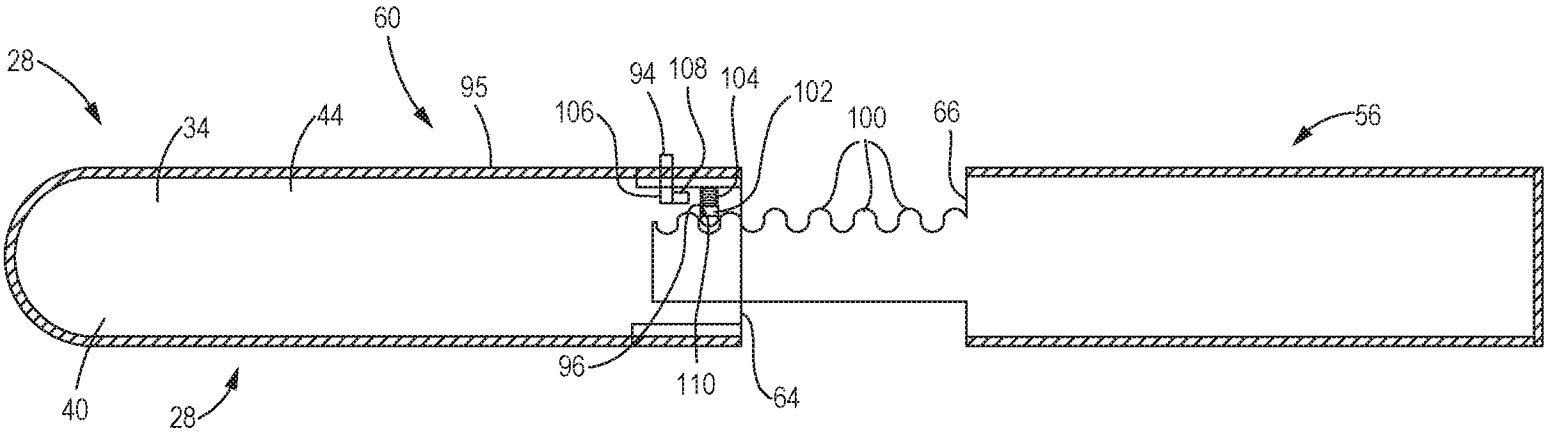
FIG. 7 is a front, cross-sectional view of the extension mechanism of the rotating door handle assembly of FIGS. 1-4 including a button, lever, magnets and spring pin, constructed in accordance with the present disclosure.

FIGS. 6 and 7 illustrate an embodiment of the extension mechanism 60 which includes a button 94 extending from a top surface 95 of the non-extendable handle portion 40. While the button 94 is shown adjacent to and extending away from the top surface 95 of the non-extendable handle portion 40, it will be understood the button 94 may also be positioned adjacent to a back surface, bottom surface or other such location of the non-extendable handle portion 40 and/or the extendable handle portion 42. As further illustrated in FIG. 6, the button 94 is operably coupled to a spring pin 96 via a lever mechanism 98. Furthermore, the bar 46 may include a plurality of notches 100 and the spring pin 96 may include a block 102 that is normally biased by a spring 104 to interact with one or more notch of the plurality of notches 100 to restrict extension and/or retraction of the bar 46.

In one non-limiting example of the extension mechanism 60 shown in FIG. 6, the second end 50 of the bar 46 is fixedly attached to the extendable handle portion 42 and the first end 48 of the bar 46 may longitudinally move within the handle cavity 44 defined in the non-extendable handle portion 40. FIG. 6 shows the adjustable handle portion 28 in the extended position 56 and the extension mechanism 60 may be used to adjust the adjustable handle portion 28 between the retracted position 52 (FIG. 1), the extended position 56 or an intermediate position in between the extended position 56 and the retracted position 52 (FIG. 1). Accordingly, activation of the button 94 (i.e., pressing the button) may cause the lever mechanism 98 to interact with the spring pin 96 to compress the spring 104 and lower or otherwise disengage the block 102 from the plurality of notches 100 defined in the bar 46. As a result, the bar 46 is able to slide or otherwise retract into the handle cavity 44 towards the first end 34 of the adjustable handle portion 28 and the extendable handle portion 42 is able to be adjusted from the extended position 56 to the retracted position 52 (FIG. 1) or into one or more intermediate positions therebetween.

In an embodiment of the extension mechanism 60 illustrated in FIG. 7, the button 94 is operably coupled to the spring pin 96 via a lever mechanism 106. Furthermore, a first magnet 108 is coupled to the lever mechanism 106 and a second magnet 110 is coupled to the spring 104 of the spring pin 96. The bar 46 may include the plurality of notches 100 and the spring pin 96 may include the block 102 that is normally biased by the spring 104 to interact with one or more notch of the plurality of notches 100 to restrict extension and/or retraction of the bar 46.

In one non-limiting example, the extension mechanism 60 shown in FIG. 7 may include the second end 50 of the bar 46 being fixedly attached to the extendable handle portion 42 and the first end 48 of the bar 46 is configured to move longitudinally within the handle cavity 44 defined within an interior area the non-extendable handle portion 40. As further shown in FIG. 7, the adjustable handle portion 28 is in the extended position 56 and the extension mechanism 60 may be used to adjust the adjustable handle portion 28 between the retracted position 52 (FIG. 1), the extended position 56 or an intermediate position in between the extended position 56 and the retracted position 52 (FIG. 1).

Accordingly, activation of the button 94 (i.e., pressing the button) may cause the lever mechanism 106 to move the first magnet 108 in proximity to the second magnet 110 such that the first magnet 108 and second magnet 110 are attracted towards one another. Such magnetic attraction may create a magnetic flux strong enough to compress the spring 104 and disengage the block 102 from the plurality of notches 100 defined in the bar 46. As a result, the bar 46 is able to slide or otherwise move into the handle cavity 44 towards the first end 34 of the adjustable handle portion 28 and the extendable handle portion 42 is able to be adjusted from the extended position 56 to the retracted position 52 (FIG. 1) or into one or more intermediate positions therebetween.

As discussed above, when the first magnet 108 and the second magnet 110 are positioned in proximity to each other a low density magnetic flux of a few Teslas may be produced (e.g., 1-2 Teslas). Furthermore, the spring 104 may be configured with a spring force greater than the magnetic force produced by the first and second magnets 108, 110. Thus, when the button 94 is released the larger spring force of the spring 104 will overcome the magnetic force between the first and second magnets 108, 110 and bias the block 102 to engage or otherwise interfere with one or more of the plurality of notches 100 and the extendable handle portion 42 will be restricted from extending and/or retracting.

Figure 8:
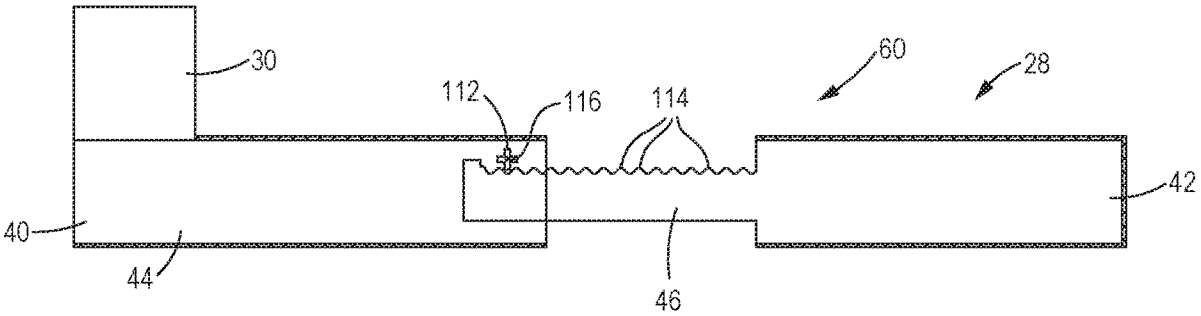
FIG. 8 is a top, cross-sectional view of the extension mechanism of the rotating door handle assembly of FIGS. 1-4 including a spur gear mounted on a vertical axle, constructed in accordance with the present disclosure.
Figure 9:
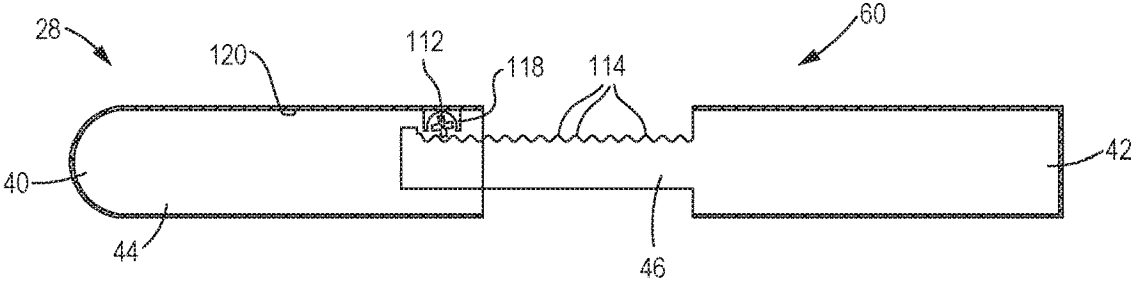
FIG. 9 is a front, cross-sectional view of the extension mechanism of the rotating door handle assembly of FIGS. 1-4 with the spur gear coupled to a bracket, constructed in accordance with the present disclosure.
Figure 10:
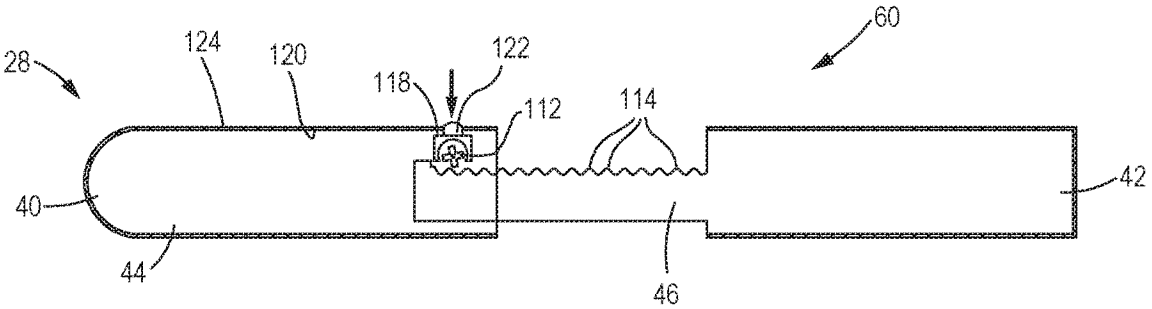
FIG. 10 is a front, cross-sectional view of the extension mechanism of the rotating door handle assembly of FIGS. 1-4 with the spur gear coupled to a bracket and button, constructed in accordance with the present disclosure.

FIGS. 8-10 illustrate an embodiment of the extension mechanism 60 which includes a spur gear 112 rotatably mounted within the handle cavity 44 of the non-extendable handle portion 40. The second end 50 of the bar 46 may be fixedly attached to the extendable handle portion 42 and the first end 48 of the bar 46 may longitudinally move within the handle cavity 44 defined in the non-extendable handle portion 40. Furthermore, the bar 46 may include a plurality of gear teeth 114 which are complimentary to the spur gear 112. Applying an external force (i.e., pulling and/or pushing) on the extendable handle portion 42 may cause the spur gear 112 to rotate along the plurality of gear teeth 114 to adjust the adjustable handle portion 28 between the extended position 56 or the retracted position 52 (FIG. 1). While the spur gear 112 is illustrated being in the extendable handle portion 42 and the bar 46 is fixedly attached to the extendable handle portion 42, it will be understood that the spur gear 112 may alternately be mounted in the extendable handle portion 42 and the bar 46 may be fixedly attached to the non-extendable handle portion 40.

In one non-limiting example illustrated in FIG. 8, the spur gear 112 may be mounted on an axle 116 that extends vertically within the handle cavity 44. Moreover, the axle 116 may extend from an interior bottom surface of the non-extendable handle portion 40 up to a height within the handle cavity 44 that aligns the spur gear 112 with the plurality of gear teeth 114 on the bar 46. As a result, the adjustable handle portion 28 may be adjusted between the extended position 56 and the retracted position 52 by pulling the extendable handle portion 42 away from the non-extendable handle portion 40 and/or pushing the extendable handle portion 42 towards the non-extendable handle portion 40.

Alternatively, as illustrated in FIG. 9, the spur gear 112 may be rotatably mounted to a gear bracket 118 that is coupled to an internal top surface of the non-extendable handle portion 40. Accordingly, the spur gear 112 is suspended within the handle cavity 44 from the internal top surface of the non-extendable handle portion 40 and the gear bracket 118 is configured to position the spur gear 112 to mesh or otherwise interact with the gear teeth 114 along the bar 46. Thus, the adjustable handle portion 28 may be adjusted between the extended position 56 and the retracted position 52 by pulling the extendable handle portion 42 away from the non-extendable handle portion 40 and/or pushing the extendable handle portion 42 towards the non-extendable handle portion 40.

As further illustrated in FIG. 10, one embodiment of the gear bracket 118 is operably coupled to a button 122 that extends through the internal top surface 120 to an external top surface 124 of the non-extendable handle portion 40. When the button 122 is in a non-activated state, the gear bracket 118 may position the spur gear 112 a specified distance above the bar 46 such that the spur gear 112 and the plurality of gear teeth 114 are not in contact or otherwise meshed with one another. As a result, the adjustable handle portion 28 may be in a locked state and the non-extendable handle portion 40 and the extendable handle portion 42 may not be adjusted between the retracted position 52 and the extended position 56. Activation (i.e., pressing) of the button 122 may actuate or otherwise move the gear bracket 118 and the spur gear 112 downwards towards the bar 46 to engage the plurality of gear teeth 114 defined along the bar 46. Accordingly, when the spur gear 112 and gear teeth 114 come into contact with each other and the adjustable handle portion 28 may be adjusted into either the extended position 56 and/or the retracted position 52 by pulling the extendable handle portion 42 away from the non-extendable handle portion 40 or pushing the extendable handle portion 42 towards the non-extendable handle portion 40.

Figure 11A:
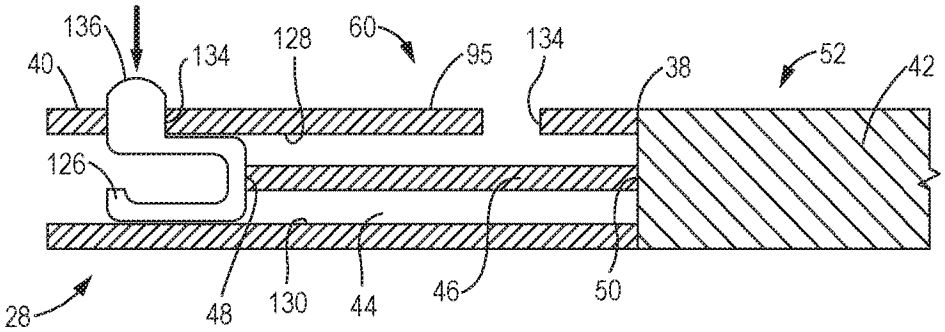
FIG. 11A is a cross-sectional view along axis A-A of a portion of the rotating door handle assembly of FIG. 3 showing an extension mechanism with a compression member, constructed in accordance with the present disclosure.
Figure 11B:
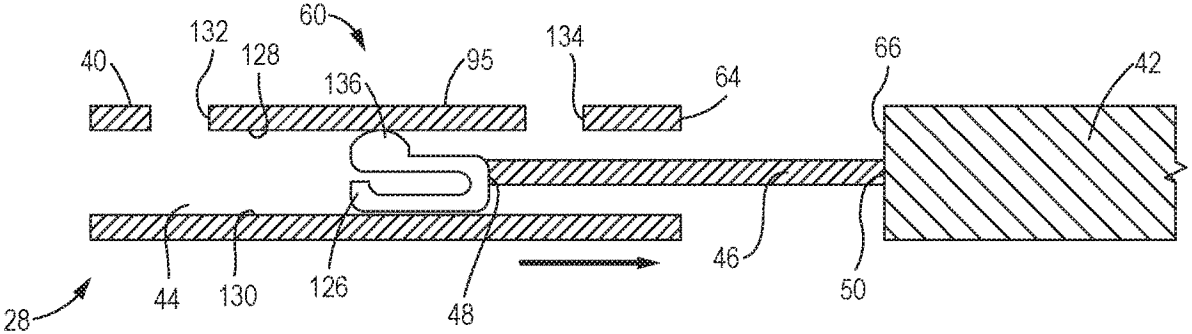
FIG. 11B is a cross-sectional view along axis A-A of the extension mechanism of FIG. 11A showing the compression member in an intermediate position, constructed in accordance with the present disclosure.
Figure 11C:
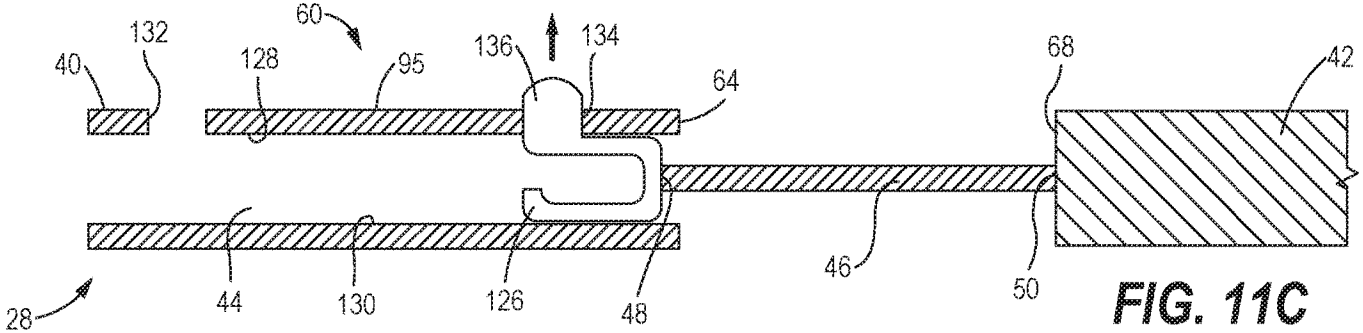
FIG. 11C is a cross-sectional view along axis A-A of the extension mechanism of FIG. 11A showing the compression member in a second locked position, constructed in accordance with the present disclosure.

Referring now to FIGS. 11A-11C, an embodiment of the extension mechanism including compression U-slider 126 is shown. The compression U-slider 126 is disposed within the handle cavity 44 of the non-extendable handle portion 40. Furthermore, the compression U-slider 126 is disposed between a first interior surface 128 and an opposing second interior surface 130 of the non-extendable handle portion 40 such that a portion of the compression U-slider 126 is in direct contact with the first interior surface 128 and the second interior surface 130. Moreover, the first end 48 of the bar 46 is fixedly attached to the compression U-slider 126 and the second end 50 of the bar 46 is fixedly attached to the extendable handle portion 42. The top surface 95 of the non-extendable handle portion 40 may include a retracted locking position 132 associated with the retracted position 52 and an extended locking position 134 associated with the extended position 56. In an embodiment, the retracted and extended locking positions 132, 134 are openings that extend through the top surface 95 of the non-extendable handle portion 40. The compression U-slider 126 may further include a tab 136 configured to align with and extend through the retracted and extended locking positions 132, 134 to lock or otherwise restrict movement of the compression U-slider 126.

As illustrated in FIG. 11A, the adjustable handle portion 28 is in the retracted position 52. The tab 136 of the compression U-slider 126 is engaged or otherwise locked into the retracted locking position 132. Accordingly, the non-extendable handle portion 40 and the extendable handle portion 42 are adjacently positioned along the handle seam 38 and the bar 46 is retracted within the handle cavity 44. Applying an external pressure (i.e., pressing) on the tab 136 as illustrated by the arrow in FIG. 11A, may compress the compression U-slider 126 and urge the tab 136 into the handle cavity 44. Such movement of the tab 136 may disengage or unlock the compression U-slider from the retracted locking position 132 and the adjustable handle portion 28 may be adjusted between the extended position 56 and the retracted position 52 by pulling the extendable handle portion 42 away from the non-extendable handle portion 40 and/or pushing the extendable handle portion 42 towards the non-extendable handle portion 40.

FIG. 11B illustrates the extension and/or retraction of the adjustable handle portion 28. During the adjustment between the retracted position 52 and the extended position 56 the compression U-slider 126 is compressed within the handle cavity 44 such that the tab 136 is slidably engaged with the first interior surface 128 and an opposing portion of the compression U-slider 126 is engaged with the second interior surface 130 of the non-extendable handle portion 40. As further illustrated in FIG. 11B, applying an external force on the extendable handle portion 42 in the direction of the arrow will cause the non-extendable handle portion 40 and extendable handle portion 42 to separate from each other at the handle seam 38. The compression U-slider 126 may continue to slide along the first and second interior surfaces 128, 130 until the tab 136 reaches the extended locking position 134.

FIG. 11C illustrates the adjustable handle portion 28 in the extended position 56 and the compression U-slider 126 being engaged with or otherwise locked into the extended locking position 134. As discussed above, during the extension of the adjustable handle portion 28, the compression U-slider 126 may slide along the first and second interior surfaces 128, 130 of the non-extendable handle portion 40. When the tab 136 reaches the extended locking position 134, the compression U-slider may expand such that the tab 136 is urged into the extended locking position 134, as illustrated by the arrow. Accordingly, the adjustable handle portion is in the extended position 56 and the non-extendable handle portion 40 and the extendable handle portion 42 are separated from one another with the bar 46 extending from the handle cavity 44 and disposed therebetween. While FIGS. 11A-11C show the retracted and extended locking positions 132, 134, it will be understood that intermediate positions may be defined to provide other extension lengths between the non-extendable handle portion 40 and extendable handle portion 42.

INDUSTRIAL APPLICABILITY

In general, the teachings of the present disclosure may find applicability in many industries including building construction and decorating industries. More specifically, the rotating door handle assembly of the present disclosure may be applicable to building and residence construction according to aging-in-place practices by providing an adjustable handle portion that includes an extension mechanism to easily adjust the handle length. Moreover, individuals with certain physical limitations brought on by advanced age or other physical conditions may experience difficulty operating doors with rotating door handles. As a result, door handles that can be adjusted between a standard and extended length may provide some benefit because the force required to twist or rotate a door handle decreases with an increase in handle length. Additionally, rotating door handle assemblies with an adjustable handle may be desirable because a single handle design can be used throughout a building. Additionally, the adjustable handle may be compliant with the Americans with Disabilities Act (ADA) guidelines and design standards for ease of use and requirements of rotating door handle assemblies used to open a larger sized door.

Figure 12:
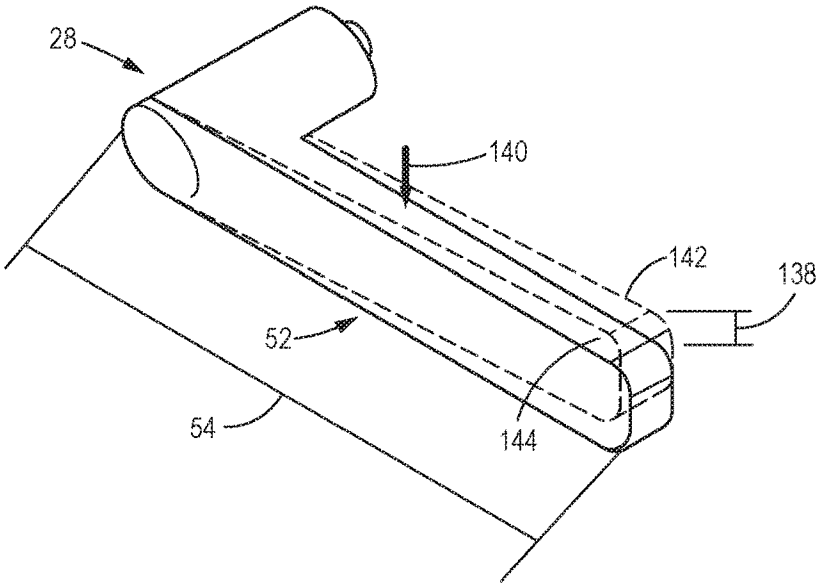
FIG. 12 is an elevated perspective view of the adjustable handle portion of the rotating door handle assembly of FIG. 1, constructed in accordance with the present disclosure.

FIG. 12 shows a retracted handle displacement 138 of the adjustable handle portion 28 when the adjustable handle portion 28 is adjusted into the first handle length 54 associated with the retracted position 52. In one non-limiting example, the first handle length 54 is approximately 5.5 inches; however, it will be understood that other lengths are possible. Accordingly, when an external force 140 is applied to the adjustable handle portion 28, the rotating door handle assembly 20 is displaced from a retracted handle starting position 142, illustrated by the dotted outline of the adjustable handle portion 28, to a retracted handle ending position 144. Accordingly, the retracted displacement handle 138 is measured as the distance between the retracted handle starting position 142 and the retracted handle ending position 144. Furthermore, in one non-limiting example the external force 140 applied to the adjustable handle portion 28 is equal to 8 $\text{pounds}_{force}$ ($\text{lb}_f$), however other force magnitudes may be used.

Figure 13:
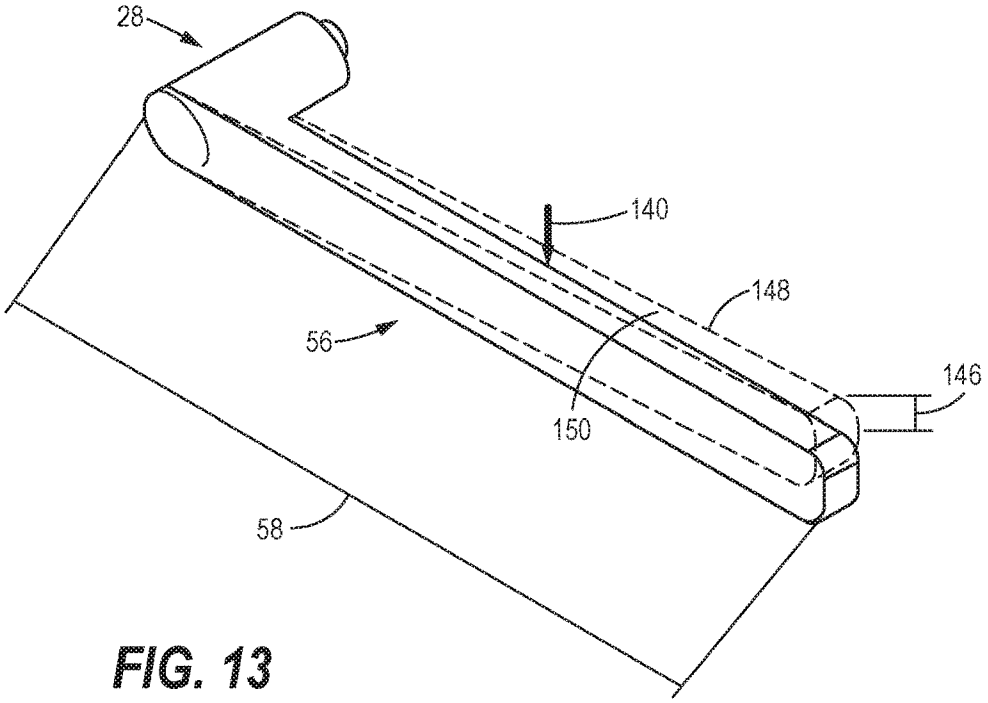
FIG. 13 is an elevated perspective view of the adjustable handle portion of the rotating door handle assembly of FIG. 2, constructed in accordance with the present disclosure.

FIG. 13, with continued reference to FIG. 12 shows an extended handle displacement 146 of the adjustable handle portion 28 when the adjustable handle portion 28 is adjusted into the second handle length 58 associated with the extended position 56. In one non-limiting example, the second handle length 58 is approximately 9.5 inches; however, it will be understood that other lengths are possible. Accordingly, when the same external force 140 (e.g., 8 $\text{lb}_f$) is applied to the adjustable handle portion 28, as shown in FIG. 13, the adjustable handle portion 28 is displaced from an extended handle starting position 148, illustrated by the dotted outline of the adjustable handle portion 28, to an extended handle ending position 150. Accordingly, the extended handle displacement 146 is measured as the distance between the extended handle starting position 148 and the extended handle ending position 150. As stated above, in this non-limiting example the external force 140 applied to the adjustable handle portion 28 in the retracted position 52 and the extended position 56 is equal to 8 $\text{lb}_f$, however other force amounts may be used.

A difference between the retracted handle displacement 138 and the extended handle displacement 146 was measured when an equal external force 140 (e.g., 8 $\text{lb}_f$) was applied to the adjustable handle portion 28 in the retracted position 52 and the extended position 56. In one non-limiting example, the total extended handle displacement 146 was about three times the magnitude of the total retracted handle displacement 138. In other words, when an equal force is applied to a shorter handle and a longer handle, the longer handle will have a larger displacement. Furthermore, it may be reasoned that a lower external force may be required to act on the adjustable handle in the extended position 56 to produce the extended handle displacement 146 that is equal to the retracted handle displacement 138. Thus, in some cases, a longer length door handle may allow a door to be opened using a lower amount of force.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only to not confuse the reader, and it is not intended that such claim term be limited, by implication or otherwise, to that single meaning.

What is claimed is:

1. A handle comprising:

a first rotatable member configured to engage a door latch mechanism; and a second member having a first end mechanically engaged with the first rotatable member and a second end opposite the first end, wherein the second member includes a non-extendable portion mechanically engaging the first rotatable member and an extendable portion operatively coupled to the non-extendable portion and moveable relative to the non-extendable portion between a non-extended position and an extended position, wherein the non-extendable portion and the extendable portion are in contact when the second member is in the retracted position and the non-extendable portion and the extendable portion are separated from each other when the second member is in the extendable position, and wherein a length of the second member from the first end to the second end is adjustable between the non-extended position with a first handle length and the extended position with a second handle length that is greater than the first handle length such that a lower external force at the second end of the second member is required to rotate the first rotatable member when the second member is in the extended position than when the second member is in the non-extended position.

2. The handle of claim 1, further comprising a bar extendably coupled between the non-extendable portion and the extendable portion of the second member.

3. The handle of claim 2, wherein a cavity is defined within a portion of at least one of the non-extendable portion and the extendable portion, and wherein the bar is enclosed within the cavity when the second member is in the non-extended position and the bar is extended from the cavity between the non-extendable portion and the extendable portion when the second member is in the extended position.

4. The handle of claim 3, further comprising a sheath portion configured to cover a portion of the bar between the non-extendable portion and the extendable portion when the second member is in the extended position.

5. The handle of claim 3, further comprising an extension mechanism operably engaged with the non-extendable portion, the extendable portion, and the bar, wherein the extension mechanism is configured to extend the bar between the non-extendable portion and the extendable portion when the second member is in the extended position and retract the bar within the cavity when the second member is in the non-extended position.

6. The handle of claim 5, wherein the extension mechanism includes a spring pin and a button operably coupled to the spring pin, and wherein activation of the button and the spring pin allows the bar to adjust the second member between the extended position and the non-extended position.

7. The handle of claim 6, wherein the extension mechanism further includes a track system defined along the bar, and wherein activation of the button engages the spring pin with the track system to allow the bar to adjust the second member between the extended position and the non-extended position.

8. The handle of claim 6, wherein the button is operably coupled to a lever mechanism and the spring pin engages with a plurality of notches defined along the bar, and wherein activation of the button causes the lever mechanism to disengage the spring pin from the plurality of notches to allow the bar to adjust the second member between the extended position and the non-extended position.

9. The handle of claim 8, wherein the button is further coupled to a first magnet and the spring pin is coupled to a second magnet, and wherein activation of the button causes the lever mechanism to adjacently position the first magnet and the second magnet such that the first and second magnets are attracted towards each other to disengage the spring pin from the plurality of notches to allow the bar to adjust the second member between the extended position and the non-extended position.

10. The handle of claim 5, wherein the extension mechanism includes a spur gear and a plurality of gear teeth defined along the bar, and wherein the spur gear engages with the plurality of gear teeth to adjust the second member between the extended position and the non-extended position.

11. The handle of claim 5, wherein the extension mechanism includes a compression mechanism operably coupled to the bar, and wherein the compression mechanism includes a tab portion and activation of the tab portion allows the bar to adjust the second member between the extended position and the non-extended position.

12. The handle of claim 1, wherein the extendable portion is not disassembled from the handle when the extendable portion moves from the non-extended position to the extended position.

13. A door handle assembly operably coupled to a door, the door handle assembly comprising:

a latch mechanism operably coupled to the door;

a mounting plate attached to a surface of the door;

a first rotatable member coupled to the mounting plate and configured to engage the latch mechanism; and a second member having a first end mechanically engaged with the first rotatable member and a second end opposite the first end, wherein the second member includes a non-extendable portion mechanically engaging the first rotatable member and an extendable portion operatively coupled to the non-extendable portion and moveable relative to the non-extendable portion between a non-extended position and an extended position, wherein the non-extendable portion and the extendable portion are in contact when the second member is in the retracted position and the non-extendable portion and the extendable portion are separated from each other when the second member is in the extendable position, and wherein a length of the second member from the first end to the second end is adjustable between the non-extended position with a first handle length and the extended position with a second handle length that is greater than the first handle length such that a lower external force at the second end of the second member is required to rotate the first rotatable member when the second member is in the extended position than when the second member is in the non-extended position.

14. The door handle assembly of claim 12, further comprising a bar extendably coupled between the non-extendable portion and the extendable portion of the second member.

15. The door handle assembly of claim 14, wherein a cavity is defined within a portion of at least one of the non-extendable portion and the extendable portion, and wherein the bar is enclosed within the cavity when the second member is in the non-extended position and the bar is extended from the cavity between the non-extendable portion and the extendable portion when the second member is in the extended position.

16. The door handle assembly of claim 15, further comprising an extension mechanism operably engaged with the non-extendable portion, the extendable portion, and the bar, wherein the extension mechanism is configured to extend the bar between the non-extendable portion and the extendable portion when the second member is in the extended position and retract the bar within the cavity when the second member is in the non-extended position.

17. The door handle assembly of claim 16, wherein the extension mechanism includes a spring pin and a button operably coupled to the spring pin, and wherein activation of the button and the spring pin allows the bar to adjust the second member between the extended position and the non-extended position.

18. The door handle assembly of claim 16, wherein the extension mechanism includes a spur gear and a plurality of gear teeth defined along the bar, and wherein the spur gear engages with the plurality of gear teeth to adjust the second member between the extended position and the non-extended position.

19. The door handle assembly of claim 16, wherein the extension mechanism includes a compression mechanism operably coupled to the bar, and wherein the compression mechanism includes a tab portion and activation of the tab portion allows the bar to adjust the second member between the extended position and the non-extended position.

20. A door handle assembly operably coupled to a door, the door handle assembly comprising:

a latch mechanism operably coupled to the door;

a mounting plate attached to a surface of the door;

a first rotatable member coupled to the mounting plate and configured to engage the latch mechanism;

an extendable handle including a non-extendable portion having a first end of the extendable handle and an extendable portion having a second end of the extendable handle opposite the first end, the extendable handle mechanically engaged with the first rotatable member at the first end; and a bar extendably coupled between the non-extendable portion and the extendable portion, wherein the bar extends a length between the non-extendable portion and the extendable portion to adjust the extendable handle between a non-extended position with a first handle length and an extended position with a second handle length that is greater than the first handle length such that a lower external force at the second end of the extendable handle is required to rotate the first rotatable member when the extendable handle is in the extended position than when the extendable handle is in the non-extended position.

21. The door handle assembly of claim 20, further comprising an extension mechanism operably engaged with the non-extendable portion, the extendable portion and the bar, wherein the extension mechanism is configured to extend the bar between the non-extendable portion and the extendable portion when the extendable handle is in the extended position, and wherein the extension mechanism is configured to retract the bar within a cavity defined within a portion of at least one of the non-extendable portion and the extendable portion when the extendable handle is in the non-extended position.

* * * * *